United States Patent [19]

D'Elia

[11] 4,364,475

[45] Dec. 21, 1982

[54] MICROFICHE TRAY

[75] Inventor: Ronald D'Elia, Greenwich, Conn.

[73] Assignee: Delco Associates, Inc., Greenwich, Conn.

[21] Appl. No.: 230,437

[22] Filed: Feb. 2, 1981

[51] Int. Cl.[3] ..... B65D 5/30; B65D 5/48; B65D 85/00

[52] U.S. Cl. ..... 206/425; 206/561; 220/7; 229/30; 264/293; 264/319

[58] Field of Search ..... 206/425, 561; 220/6, 220/7; 229/30, 32; 264/293, 319

[56] References Cited

U.S. PATENT DOCUMENTS

| | | | |
|---|---|---|---|
| 3,446,415 | 5/1969 | Bromley | 229/30 |
| 3,675,808 | 7/1972 | Brink | 229/30 |
| 3,900,157 | 8/1975 | Roth | 229/30 |
| 4,209,093 | 6/1980 | Soderland | 206/425 |

*Primary Examiner*—William T. Dixson, Jr.
*Attorney, Agent, or Firm*—Hane, Roberts, Spiecens & Cohen

[57] ABSTRACT

A tray and its method of formation for supporting card-like articles in juxtaposed relation therein comprising a one-piece body of plastic material molded in flat form with a base, a pair of opposite side parts and a pair of opposite end parts. The side parts and end parts are joined to the base by fold lines about which the parts can be upfolded to form side walls and end walls for the tray. The end walls have tabs at their lateral edges and the side walls are formed with slots which receive the tabs when the walls are in upfolded condition. The end walls form an angle with the vertical in the secured position and the lateral edges are engaged between pairs of ribs formed on the side walls.

11 Claims, 6 Drawing Figures

MICROFICHE TRAY

FIELD OF THE INVENTION

The invention is directed to a tray for supporting articles in juxtaposed relation and, particularly, for supporting card-like articles such as microfiche. The invention also relates to a method of forming the tray.

PRIOR ART

Numerous constructions are known for the formation of trays for card-like articles. These include trays which are molded to shape. It is relatively difficult and expensive to mold shaped articles and this represents a disadvantage of the trays of the prior art. Also known are trays which are formed by using adhesives, fasteners, etc. to secure wall parts to one another and the base.

U.S. Pat. No. 1,667,320 shows a typical example of a tray. This tray is made of cardboard and is assembled by the use of gluing strips and the like. The use of cardboard is undesirable since it does not have long life and if a stronger material is used, this poses difficulties as regards assembly.

U.S. Pat. No. 2,258,666 shows a card file box employing a supplemental card support member. The card support member is made of a flexible material such a hard-thin-fiber which involves an additional expense above and beyond that of the box.

U.S. Pat. No. 2,665,808 also shows an outer box with an inner insert piece adapted for support of articles to be stored in the box.

U.S. Pat. No. 2,701,635 is directed to a storage file for photographic slides and comprises a shaped tray with integral ribs and bosses for receiving separators.

U.S. Pat. No. 2,781,125 is directed to a storage file for photographic slides which comprises a shaped tray with divider means therein.

U.S. Pat. No. 2,829,767 is directed to a holder for photographic transparencies comprising a shaped tray with means therein for the support of slides.

U.S. Pat. No. 3,370,701 is drawn to a card file composed of a shaped tray with separator plates affixed therein.

SUMMARY OF THE INVENTION

An object of the invention is to provide a tray for supporting juxtaposed articles such as cards and, especially, microfiche in which the need for a shaped tray is obviated.

A further object of the invention is to provide a tray which is assembled from a one-piece body of plastic material which is molded flat.

Still another object of the invention is to provide a tray whose construction is simple and which is readily assembled from said one-piece body without the need for tools.

A further object of the invention is to form the one-piece body with a base, a pair of opposite side parts and a pair of opposite end parts in which the side parts and end parts are upfolded from the base and secured together by interlocking means on said parts.

A further object of the invention is to provide the one-piece body with integrated hinges between the bottom and the end and side parts to permit folding of said parts with respect to the bottom.

Yet, another object of the invention is to form the interlocking means as tabs and slots so arranged that the side parts and end parts are secured in stable relation in upfolded position on the base.

In accordance with the above and further objects of the invention, there is provided a tray comprising a base, a pair of opposite side parts and a pair of opposite end parts, wherein the base and side parts and end parts are made from a relatively thin one-piece body. The body is a plastic material which is molded flat with the base side parts and end parts in a common plane. The side parts and end parts are upfolded from the base and are locked in upfolded position by engagement of interlocking means on the side parts and end parts. Articles such as cards and especially microfiche are supportable in juxtaposed relation by being placed in standing position on the base.

The invention further contemplates that the side parts and end parts are foldably joined to the base along respective fold lines at which the plastic material is reduced in thickness to form hinges.

The interlocking means comprises tabs and slots wherein the slots extend at an angle to the fold lines so that when the tabs are engaged in the slots, the end parts form an angle with the vertical.

Adjacent the slots are ribs in which are inserted the edges of the parts with the tabs so as to be held thereat.

According to a feature of the invention, the reduction in thickness of the material at the fold lines is formed by V-shaped notches whose angles are correlated to the angle at which the parts are upfolded from the base.

A further object of the invention is to provide a method for forming a tray for supporting card-like articles in juxtaposed upstanding relation.

In accordance with the method of the invention, a one-piece body of plastic material is molded in flat form with a base, end parts and side parts. The body has lines of reduced thickness between the base and the side and end parts to form hinge lines thereat and, in order to assemble the tray, the side and end parts are upfolded from the base and each end part is interlocked with the side parts to hold the parts in secured stable relation in upfolded position on the base. The interlocking of the parts is effected by inserting a tab on one part into a slot in the other part.

DETAILED DESCRIPTION

Figure 1:
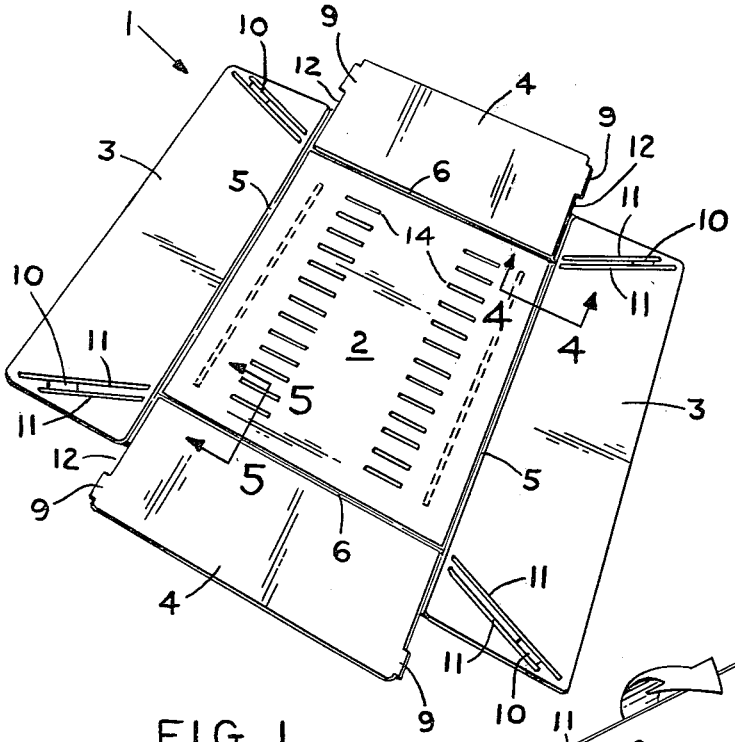
FIG. 1 is a perspective view of a tray in molded flat condition.
Figure 2:
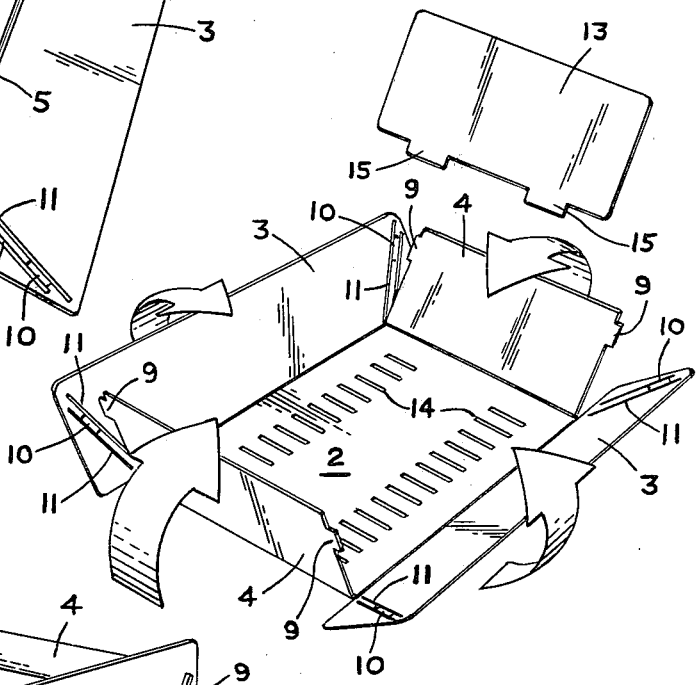
FIG. 2 is a perspective view showing the tray in the course of assembly thereof.
Figure 3:
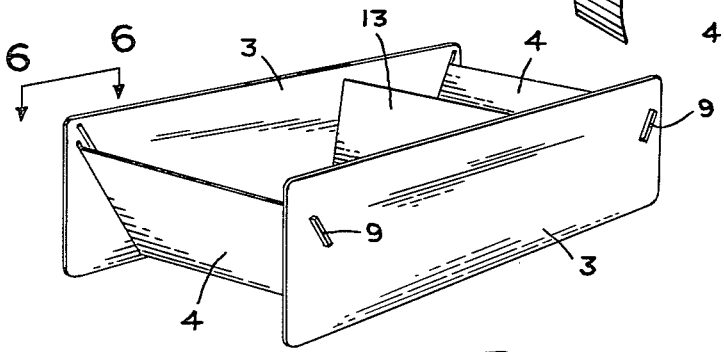
FIG. 3 is a perspective view showing the tray in assembled condition.
Figure 4:
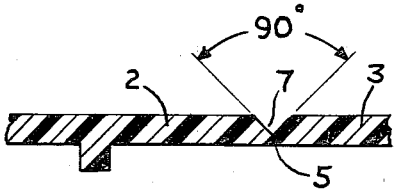
FIG. 4 is a sectional view taken on line 4—4 in FIG. 1.
Figure 5:
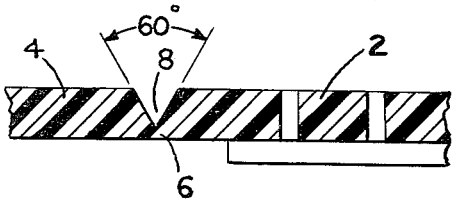
FIG. 5 is a view taken on line 5—5 in FIG. 3.
Figure 6:
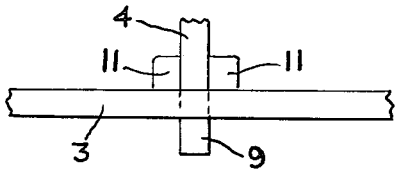
FIG. 6 is a view taken along line 6—6 in FIG. 3.

Referring to the drawing, there is seen a tray 1 which in FIG. 1 is shown in flat molded condition and is constituted as a one-piece body of plastic material. The tray 1 comprises a base 2 to which are foldably joined, opposed side parts 3 and opposed end parts 4. The side parts 3 are joined to the base by fold lines 5 and the end parts 4 are joined to the base by fold lines 6. The fold lines are formed by reducing the thickness of the material of the tray thereat. As seen in FIG. 4, the fold line 5 is formed by forming a V-shaped notch 7 having an angle of 90° in the upper surface of the material of the tray. As seen in FIG. 5, the fold line 6 is formed by providing a V-shaped notch 8 of an angle of 60° in the material of the tray. Effectively, the fold lines 5 and 6 serve as hinges allowing the side parts 3 and the end parts 4 to be upfolded through the angle formed by the notches 7 and 8. As seen in FIG. 3, the side parts 3 in the assembled position extend at right angles with respect to the base 2 whereas the end parts 4 extend at an angle of 60° with respect to the base.

The material of the tray is of plastic material, preferably polypropylene in which the notches can be readily formed and the hinges adapted for the folding of the bars with respect to the base.

In order to secure the side parts and end parts in stable relation in the upfolded, assembled position as shown in FIG. 3, the end parts 4 are provided with laterally projecting tabs 9 at their upper edges and the side parts are provided with slots 10 in which the tabs 9 can be inserted. The slots 10 extend at an angle with respect to the associated hinge line 5, said angle corresponding to the angle of the notch 8. Namely, as shown in FIG. 1, the slots 10 extend at an angle of 60° with respect to the associated fold line 5. Extending parallel to the slots 10 on opposite sides thereof are ribs 11. The ribs 11 extend at one end to a position proximate the associated fold line 5 and at the other end to the edge of the side part 3. When the tabs 9 are inserted into the slots 10, the lateral edges 12 of the end parts 4 are received between the ribs 11 and a secured, stable assembly is formed. The angular position of the end parts 4 with respect to the base and the corresponding angular formation of the notch 8 provides for a resilient biassing action by which the lateral edges 12 of the end parts 4 are gripped in the space between the ribs 11 so that the ribs and the side parts 3 and end parts 4 are held in stable, assembled relation. In order to ensure the secured, stable position of the parts, the spacing between the ribs is such that the tabs 9 and the lateral edges 12 will snugly fit between the ribs. The height of the ribs should be at least 30% greater than the thickness of the material of the parts 3 to provide sufficient gripping area for the edges 12 of the end parts 4.

In order to divide the space within the tray, one or more dividers 13 can be inserted into slots 14 in the base 2 of the tray. For this purpose, the dividers are formed with lugs 15 at their lower edges and the slots 14 are arranged in two rows so that each pair of lugs 15 at the bottom of a divider are engaged in slots 14 in the two rows. The articles to be stored in the tray are stacked in upright, standing position on the base 2, optionally between the dividers 13. The articles to be stored are microfiche on cards although other elements are also suitable.

Although the invention has been described in conjunction with one embodiment thereof, it will become apparent to those skilled in the art that numerous modifications and variations can be made without departing from the scope and spirit of the invention as defined in the attached claims.

What is claimed is:

1. A tray for supporting juxtaposed articles comprising a base, a pair of opposite side parts and a pair of opposite end parts, said base said parts and end parts being made from a relatively thin, one-piece body, said side parts and end parts being upfolded from said base and interlocking means on said side parts and said end parts to lock said side parts and end parts in upfolded position, the articles being supportable in juxtaposed relation on the base, said interlocking means comprising tabs and slots, said tabs being on one of said pair of parts and said slots being provided in the other of said pair of parts, said tabs being engageable in said slots, said tabs and slots being arranged to hold said side parts and end parts in secured, stable relation in upfolded position on said base, said one pair of parts having opposite edges at which said tabs project, said other pair of parts including ribs on opposite, sides of said slots extending parallel therewith and projecting from said other pair of parts for releasably holding said edges of said first pair of parts with said tabs engaged in said slots and blocking relative pivotal movement of said parts.

2. A tray as claimed in claim 1 wherein said one-piece body is a plastic material which is molded flat with said base, side parts and end parts in a common plane.

3. A tray as claimed in claim 2 wherein said side parts and end parts are foldably joined to said base along respective fold lines, said plastic material having reduced thickness at said fold lines to form hinges thereat.

4. A tray as claimed in claim 3 wherein said slots extend at an angle with respect to the hinge joining the associated one of said other parts to the base.

5. A tray as claimed in claim 4 wherein said end parts are provided with said tabs and said side parts are provided with said slots, the angle between said slots and ribs and the associated hinges being such to hold said end parts at an angle of about 60° with respect to said base.

6. A tray as claimed in claim 5 in which the tray further comprises means on the base for releasably supporting dividers thereon at adjustable positions.

7. A tray as claimed in claim 6 wherein said reduced thickness at said fold lines is formed by the provision of V-shaped notches in said material, the angle of said V-shaped notches corresponding to the angle at which said parts are secured in upfolded position from said base.

8. A tray as claimed in claim 7 wherein the dividers are provided with depending lugs, said means on the base for releasably supporting the dividers thereon being constituted by rows of spaced slots.

9. A method of forming a tray for supporting card-like articles in juxtaposed relation, said method comprising molding in flat form, a one-piece body of plastic material having a base and opposed end parts and side parts, said body having lines of reduced thickness between the base and the side and end parts to form hinge lines thereat, upfolding the side and end parts from the base, and interlocking each end part with the side parts to hold said parts in secured, stable relation in upfolded position on said base, the interlocking of the parts being effected by inserting a tab on one part into a slot in the other part and engaging the edge of said one part between parallel ribs on the other part disposed on opposite sides of said slot.

10. A method as claimed in claim 9 wherein said slot ribs extend along a line of inclination so that said end parts are secured in inclined position with respect to the vertical.

11. A method as claimed in claim 10 comprising removably inserting dividers into the base to sub-divide the interior space in the tray.

* * * * *